US006332938B1

(12) United States Patent
Sugawara

(10) Patent No.: US 6,332,938 B1
(45) Date of Patent: Dec. 25, 2001

(54) PROCESS FOR PRODUCING FE-BASED MEMBER HAVING HIGH YOUNG'S MODULUS AND HIGH TOUGHNESS

(75) Inventor: Takeshi Sugawara, Wako (JP)

(73) Assignee: Honda Giken Kogyo Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/373,600

(22) Filed: Aug. 13, 1999

(30) Foreign Application Priority Data

Aug. 18, 1998 (JP) ..... 10-247833

(51) Int. Cl.[7] ..... C21D 5/00
(52) U.S. Cl. ..... 148/543; 148/545; 148/612
(58) Field of Search ..... 148/612, 662, 148/543, 545

(56) References Cited

U.S. PATENT DOCUMENTS 4,838,956 * 6/1989 Satou et al. ..... 148/3
4,867,804 * 9/1989 Kobayashi ..... 148/3

FOREIGN PATENT DOCUMENTS 56-047518 * 4/1981 (JP) .

* cited by examiner

*Primary Examiner*—Roy King
*Assistant Examiner*—Janelle Combs Morillo
(74) *Attorney, Agent, or Firm*—Armstrong, Westerman, Hattori, McLeland & Naughton, LLP

(57) ABSTRACT

The present invention produces an Fe-based member having a high Young's modulus and a high toughness. In producing an Fe-based member, a first step and a second step are sequentially carried out. At the first step, an Fe-based material comprising 1.5% by weight≦C≦2.5% by weight 1.4% by weight≦Si≦3.5% by weight 0.9% by weight≦Mn≦1.7% by weight 0.5% by weight≦Ni≦1.5% by weight, and the balance of Fe including inevitable impurities is subjected to a thermal treatment at a heating temperature set in a range of $T_S<T_1<T_L$ and under a quenching condition, wherein $T_S$ represents a solidus temperature of the Fe-based material, and $T_L$ represents a liquidus temperature. Then, at the second step, the resulting Fe-based material is subjected to a thermal treatment at a heating temperature $T_2$ set in a range of Te1<$T_2$<Te2 and for a heating time t set in a range of 90 min≦t≦180 min, wherein Te1 represents a eutectic transformation starting temperature, and Te2 represents a eutectic transformation finishing temperature.

4 Claims, 6 Drawing Sheets

PROCESS FOR PRODUCING FE-BASED MEMBER HAVING HIGH YOUNG'S MODULUS AND HIGH TOUGHNESS

BACKGROUND OF THE INVENTION

1. Field of the Invention

The present invention relates to a process for producing an Fe-based member having a high Young's modulus and a high toughness.

2. Description of the Related Art

There is a conventionally known method for increasing the Young's modulus of an Fe-based member by compounding a dispersant such as a reinforcing fiber, reinforcing granules and the like having a high Young's modulus to a matrix of the Fe-based member.

With this method, however, the following problem arises: the dispersant is coagulated in the matrix, and when the surface nature of the dispersant is poor, the toughness of the produced Fe-based member is largely injured.

SUMMARY OF THE INVENTION

It is an object of the present invention to provide a producing process as described above, wherein a particular metallographic structure is produced by subjecting an Fe-based material having a particular composition to a particular treatment, thereby enabling the mass production of an Fe-based member having both of a high Young's modulus and a high toughness.

To achieve the above object, according to the present invention, there is provided a process for producing an Fe-based member having a high Young's modulus and a high toughness, comprising a first step of subjecting an Fe-based material which comprises 1.5% by weight$\leqq$C$\leqq$2.5% by weight 1.4% by weight$\leqq$Si$\leqq$3.5% by weight 0.9% by weight$\leqq$Mn$\leqq$1.7% by weight 0.5% by weight$\leqq$Ni$\leqq$1.5% by weight and the balance of Fe including inevitable impurities to a thermal treatment at a heating temperature $T_1$ set in a range of $T_S<T_1<T_L$ and under a quenching condition, wherein $T_s$ represents a solidus temperature of the Fe-based material and $T_L$ represents a liquidus temperature, and a second step of subjecting the Fe-based material to a thermal treatment at a heating temperature $T_2$ set in a range of Te1$<T_2<$Te2 and for a heating time t set in a range of 90 min$\leqq$t$\leqq$180 min, wherein Te1 represents a eutectic transformation starting temperature and Te2 represents a eutectic transformation finishing temperature.

When the Fe-based material is subjected to the thermal treatment at the first step, the solidified structure is modified into a primary thermally treated structure. The primary thermally treated structure comprises a large number of residual γ-phases which are, for example, in a massive form, a coalesced carbide phase present between adjacent residual γ-phases, and a plurality of acicular martensite α-phases present in each of the residual γ-phases. If the condition is changed at the first step, it is impossible to provide the primary thermally treated structure as described above. In the quenching, the cooling rate CR is equal to or higher than that in the usual oil-cooling and in the forcible air-cooling and hence, is set at CR$\geqq$250° C./min. For this purpose, for example, the oil-cooling, the water-cooling and the like are utilized.

If the Fe-based material having the primary thermally treated structure is then subjected to the thermal treatment at the second step, the primary thermally treated structure is modified into a secondary thermally treated structure. This secondary thermally treated structure comprises a large number of fine α-grain groups which are, for example, in a massive form, a large number of fine short fiber-shaped carbide agglomerates and a large number of graphite grains present between adjacent fine α-grain groups, fine carbide grains as a large number of fine carbide grains and several fine graphite grains present in the grain boundary in the fine α-grain groups, and one or two or more acicular precipitated γ-phases present in the particular fine α-grain group and extending to divide the particular fine α-grain group. In this case, the fine carbide grains are present independently or as an aggregate.

In the secondary thermally treated structure, the fine carbide grains contribute to an increase in Young's modulus of the Fe-based member, and the precipitated γ-phase contributes to an enhancement in roughness of the Fe-based member.

In the second step, if the heating temperature $T_2$ is lower than Te1, or the heating time t is shorter than 90 min, the fine division and dispersion of the carbide cannot be sufficiently performed. On the other hand, if the heating temperature $T_2$ is higher than Te2, or the heating time t is longer than 180 min, the agglomeration of the carbide grains occurs with the advance of the graphitization.

In the composition of the Fe-based material, carbon (C) produces carbide which serves to drop the liquidus temperature $T_L$ and the solidus temperature $T_S$ to enhance the castability of the Fe-based material and contribute to an increase in Young's modulus. To increase the amount of the carbide, it is necessary to add the carbon in an amount equal to or larger than a solid solution limit. Therefore, the lower limit of the C content is defined at 1.5% by weight. On the other hand, if C>2.5% by weight, not only the amount of carbide but also the amount of graphite are increased and for this reason, the Fe-based member is rendered brittle.

Silicon (Si) drops the melting point of the Fe-based material to improve the castability, and promotes the deacidification and graphitization of the Fe-based material and produces an α-phase solid-solution in the Fe-based material to reinforce the Fe-based material. In addition, silicon (Si) has an effect of increasing the temperature difference ΔT between the eutectic transformation starting temperature Te1 and the eutectic transformation starting temperature Te2, namely widening the range of heating temperature $T_2$ set at the second step. However, if the Si content is lower than 1.4% by weight in the combination with carbon (C), the above-described effect cannot be provided. On the other hand, if Si>3.5% by weight, the α-phase is made brittle, resulting in a degraded mechanical property of the Fe-based member.

Manganese (Mn) has an effect of promoting the deacidification and the production of carbide and increasing the temperature difference ΔT. Nickel (Ni), which is the other alloy element, has an effect of inhibiting the production of carbide. Therefore, to overcome the effect of the nickel to promote the production of carbide, the lower limit of the Mn content is set at 0.9% by weight. On the other hand, if Mn>1.7% by weight, the Fe-based member is rendered brittle. Nickel (Ni) is a γ-phase producing element, and has an effect of permitting the precipitated γ-phase to exist in a smaller amount at ambient temperature to enclose impurities therein, thereby enhancing the toughness of the Fe-based member. To provide such effect, it is desirable that the Ni content is set at about 1% by weight. In addition, nickel (Ni) exhibits a remarkable effect for increasing the temperature difference ΔT. However, if the Ni content is lower than 0.5% by weight, both of such effects cannot be provided. On the other hand, even if the Ni content is set to a value larger than 1.5% by weight, the increment in the temperature difference ΔT is not varied.

In addition, according to the present invention, there is provided a process for producing an Fe-based member similar to that described above, wherein the heating temperature $T_1$ relative to the liquidus temperature $T_L$ is set at $T_1>T_L$ at a first step at which a quenching similar to that described above is carried out, and then, a second step similar to that described above is carried out.

A thermal treated structure similar to the secondary thermally treated structure can be produced even by this process.

BRIEF DESCRIPTION OF DRAWINGS

FIG. 4 is a photomicrograph showing the primary thermally treated structure (metallographic structure) of an Fe-based material a.

DETAILED DESCRIPTION OF THE PREFERRED EMBODIMENTS

Table 1 shows compositions of an Fe-based material a used in an example and an Fe-based material b used in a comparative example. Both the Fe-based materials a and b were produced in a die-casting progress.

TABLE 1

| | Chemical constituent (% by weight) | | | | | | |
|---|---|---|---|---|---|---|---|
| | C | Si | Mn | P | S | Ni | Fe |
| Example, Fe-based material a | 2.0 | 2.05 | 1.2 | <0.04 | <0.04 | 1.1 | Balance |
| Comparative example, Fe-based material b | 2.05 | 2.05 | 0.65 | <0.04 | <0.04 | — | Balance |

Figure 1:
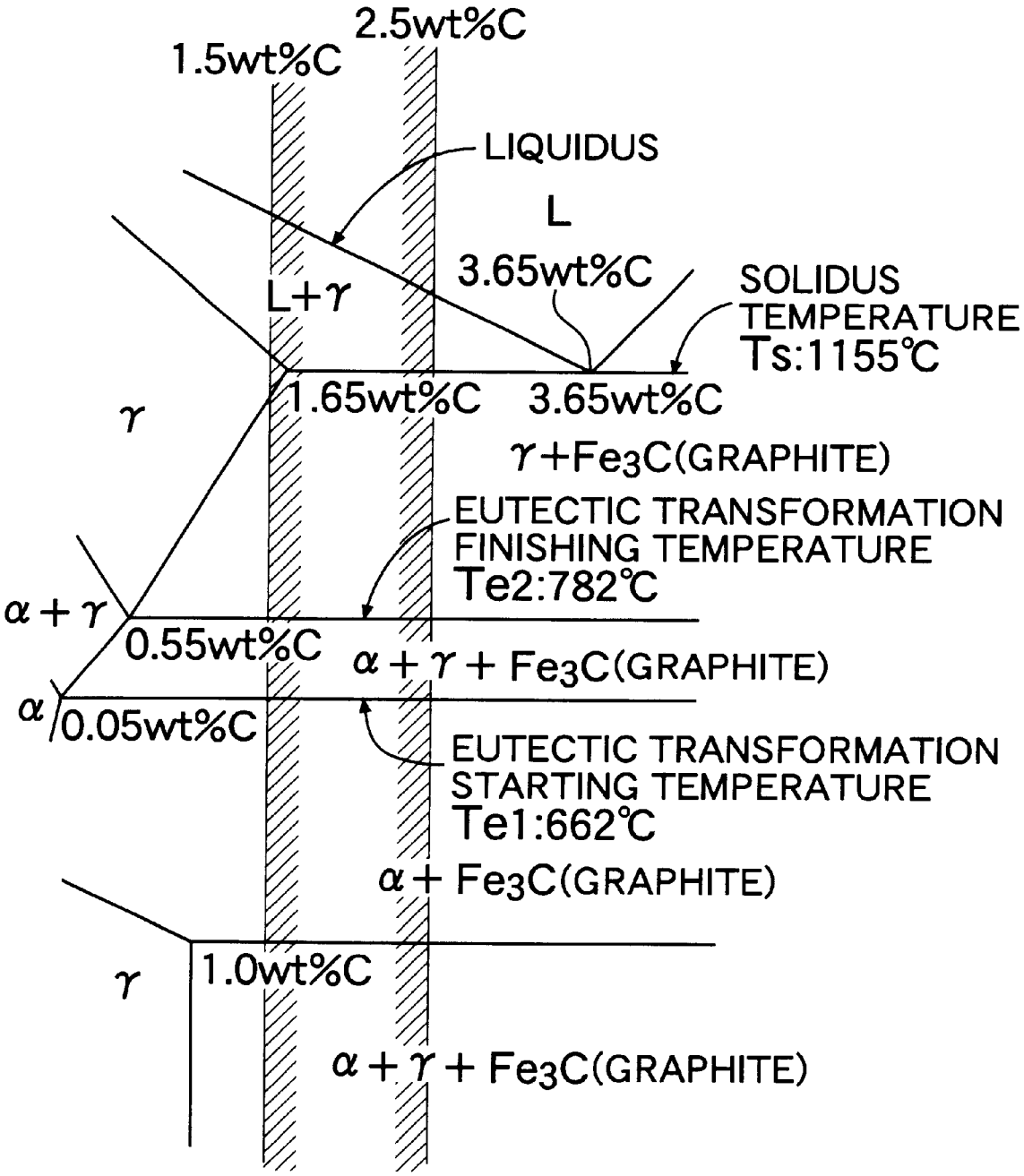
FIG. 1 is an essential portion of a phase diagram for an Fe-based material.

FIG. 1 shows a portion of a phase diagram of an Fe-based material a. In this case, the solidus temperature $T_S$ is 1155° C.; the liquidus temperature $T_L$ is 1323° C.; the eutectic transformation starting temperature Te1 is 662° C.; and the eutectic transformation finishing temperature Te2 is 782° C. For the Fe-based material b, the solidus temperature $T_S$ is 1159° C.; the liquidus temperature $T_L$ is 1319° C.; the eutectic transformation starting temperature Te1 is 747° C.; and the eutectic transformation finishing temperature Te2 is 782° C.

Figure 2:
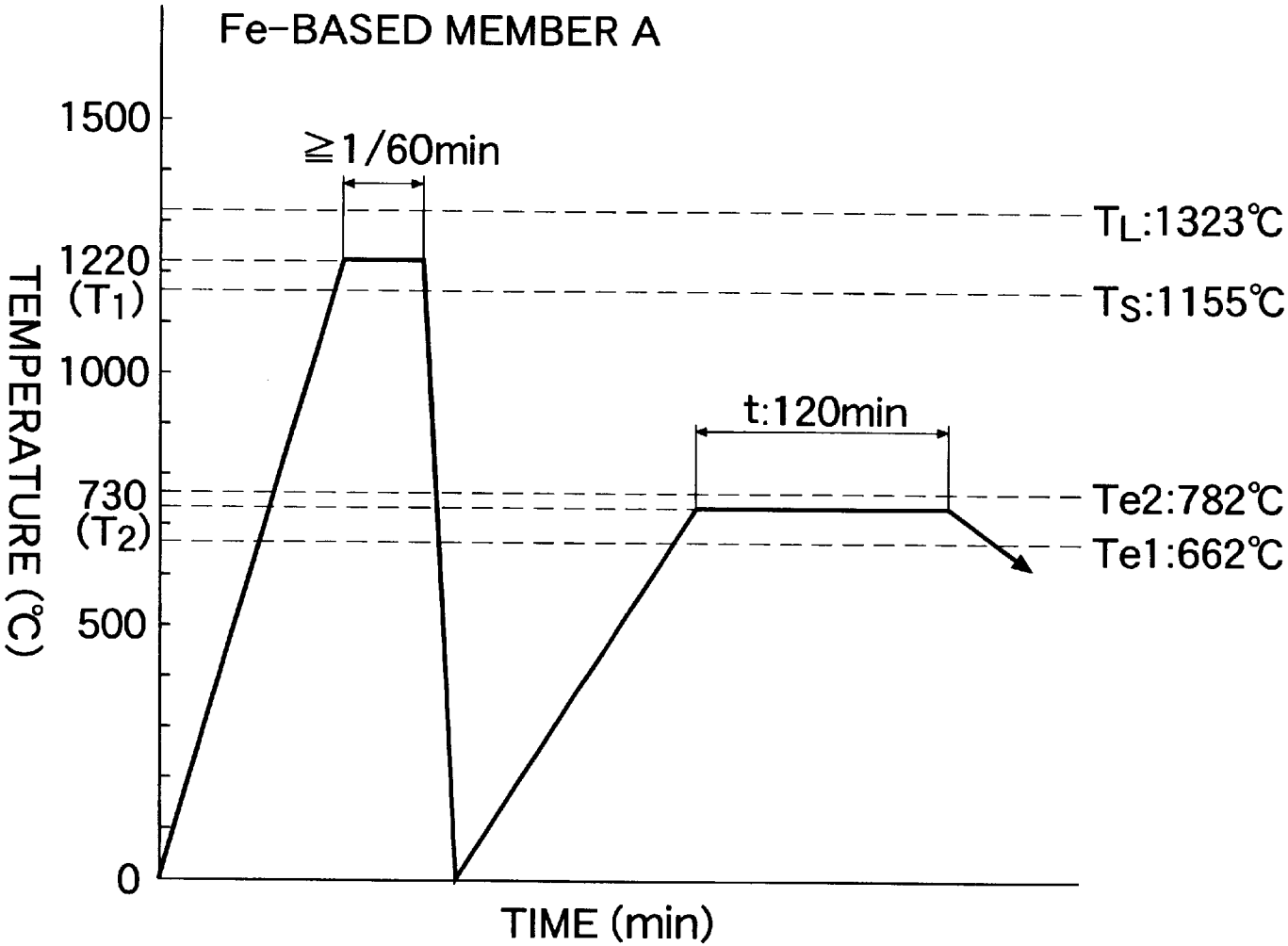
FIG. 2 shows a heat cycle for producing an Fe-based member A.
Figure 3:
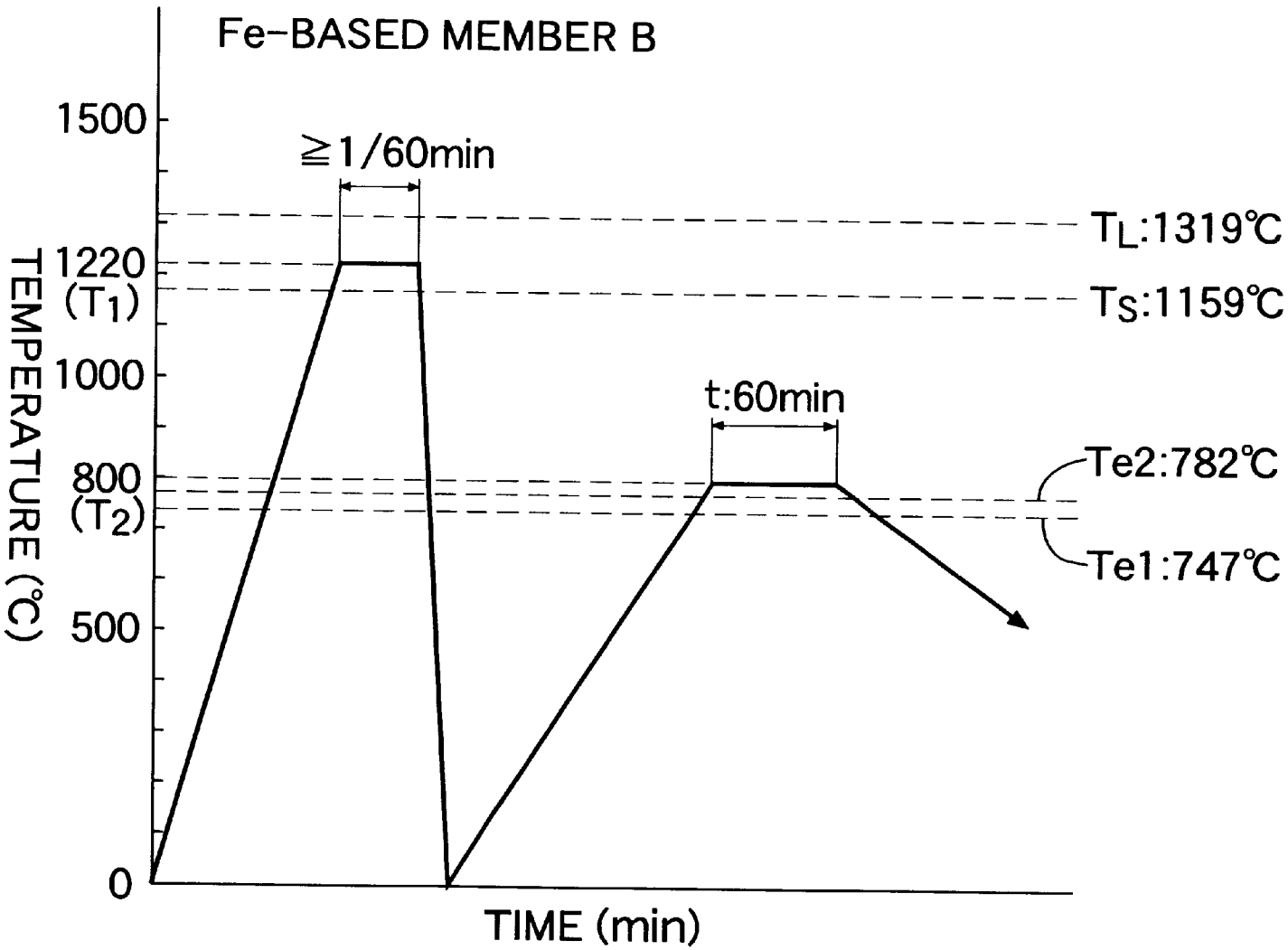
FIG. 3 shows a heat cycle for producing an Fe-based member B.

First and second steps were carried out using both the Fe-based materials a and t under conditions shown in Table 2 and FIGS. 2 and 3 to produce an Fe-based member A corresponding to the Fe-based material a and an Fe-based member B corresponding to the Fe-based material b.

TABLE 2

| | First Step | | Second step | | |
|---|---|---|---|---|---|
| | Heating temperature (°C.) | Cooling rate (° C./mi) | Heating temperature (° C.) | Heating time (min) | Cooling means |
| Fe-based member A | $T_1$: 1220<br>[ $T_S$: 1115 ]<br>$T_1$: 1323 | CR: 1300 | $T_2$: 730<br>[ Te1: 662 ]<br>Te2: 782 | t: 120 | Air-cooling |
| Fe-based member B | $T_1$: 1220<br>[ $T_S$: 1159 ]<br>$T_L$: 1319 | CR: 1300 | $T_2$: 800<br>[ Te1: 747 ]<br>Te2: 782 | t: 60 | Air-cooling |

Figure 4:
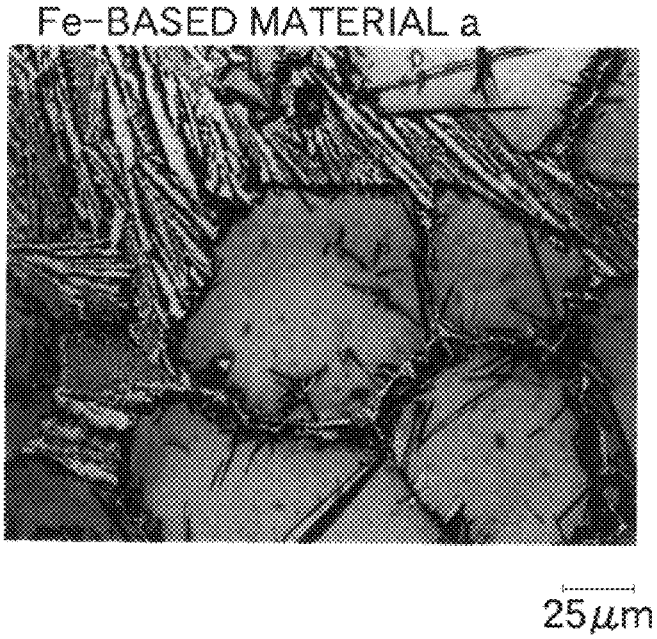
Figure 5:
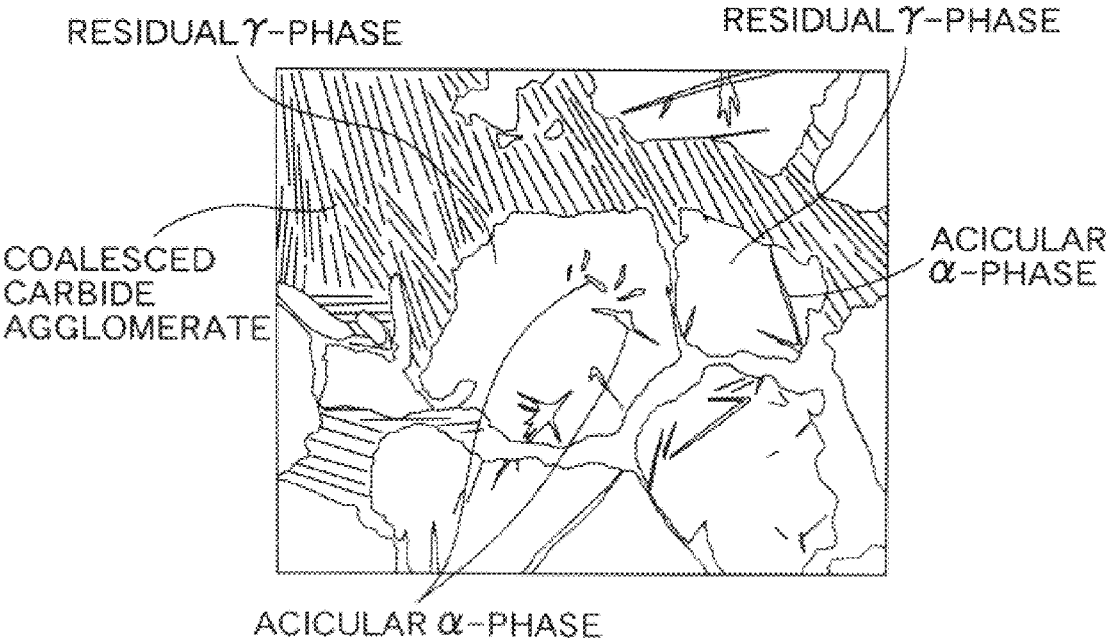
FIG. 5 is a substantial tracing of FIG. 4.

FIG. 4 is a photomicrograph showing the primary thermally treated structure (metallographic structure) of the Fe-based material a obtained through the first step, and FIG. 5 is a substantial tracing of FIG. 4. The primary thermally treated structure comprises a large number of massive residual γ-phases, coalesced carbide agglomerates present between the adjacent residual γ-phases, and a plurality of acicular martensite α-phases present in the residual γ-phase.

Figure 6:
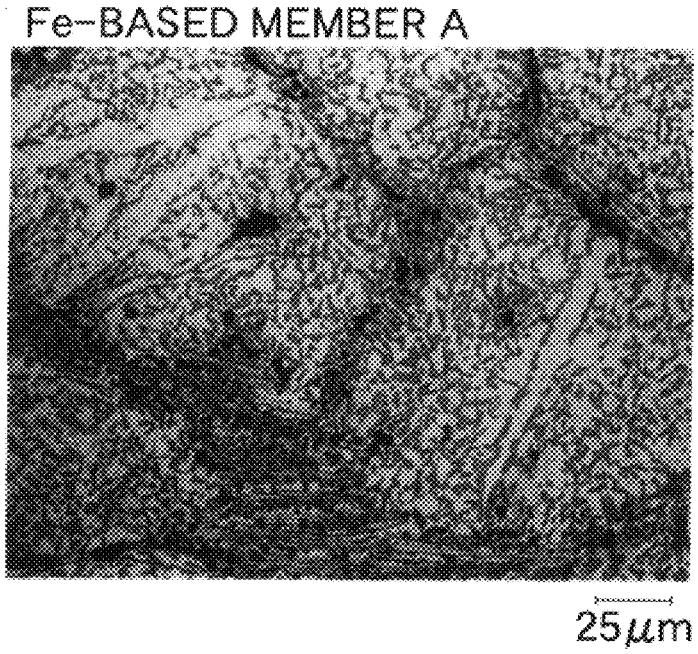
FIG. 6 is a photomicrograph showing the secondary thermally treated structure (metallographic structure) of the Fe-based member A.
Figure 7:
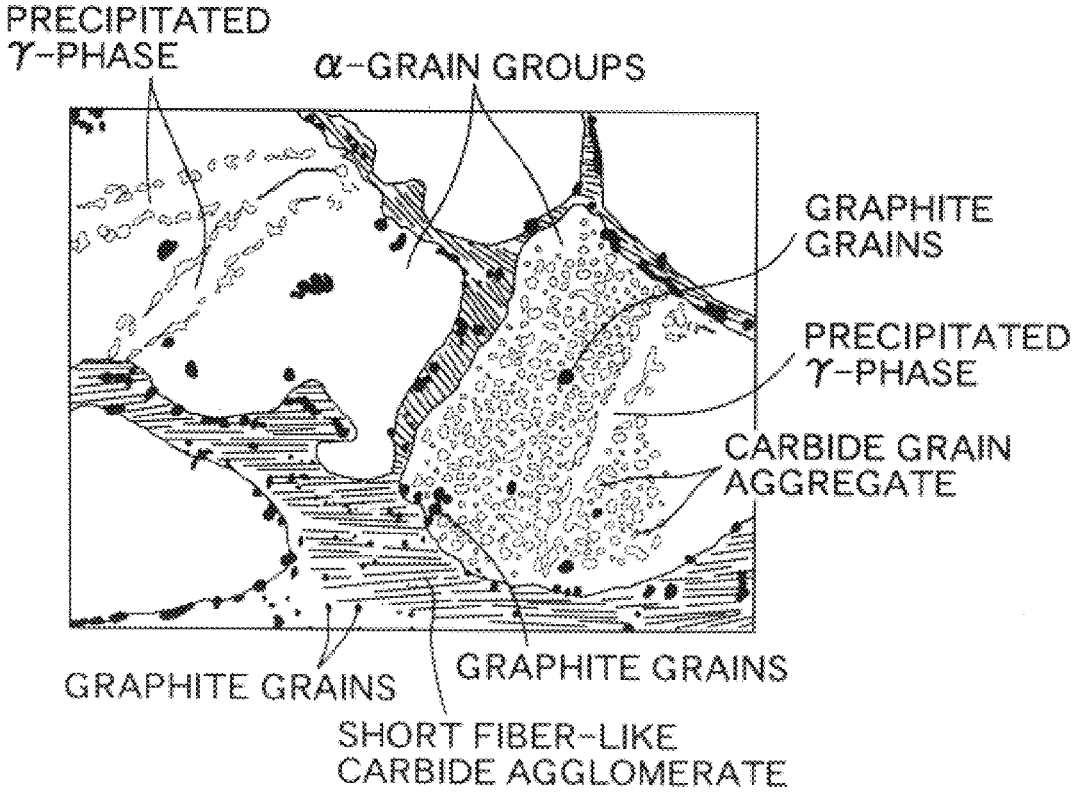
FIG. 7 is a substantial tracing of FIG. 6.
Figure 8:
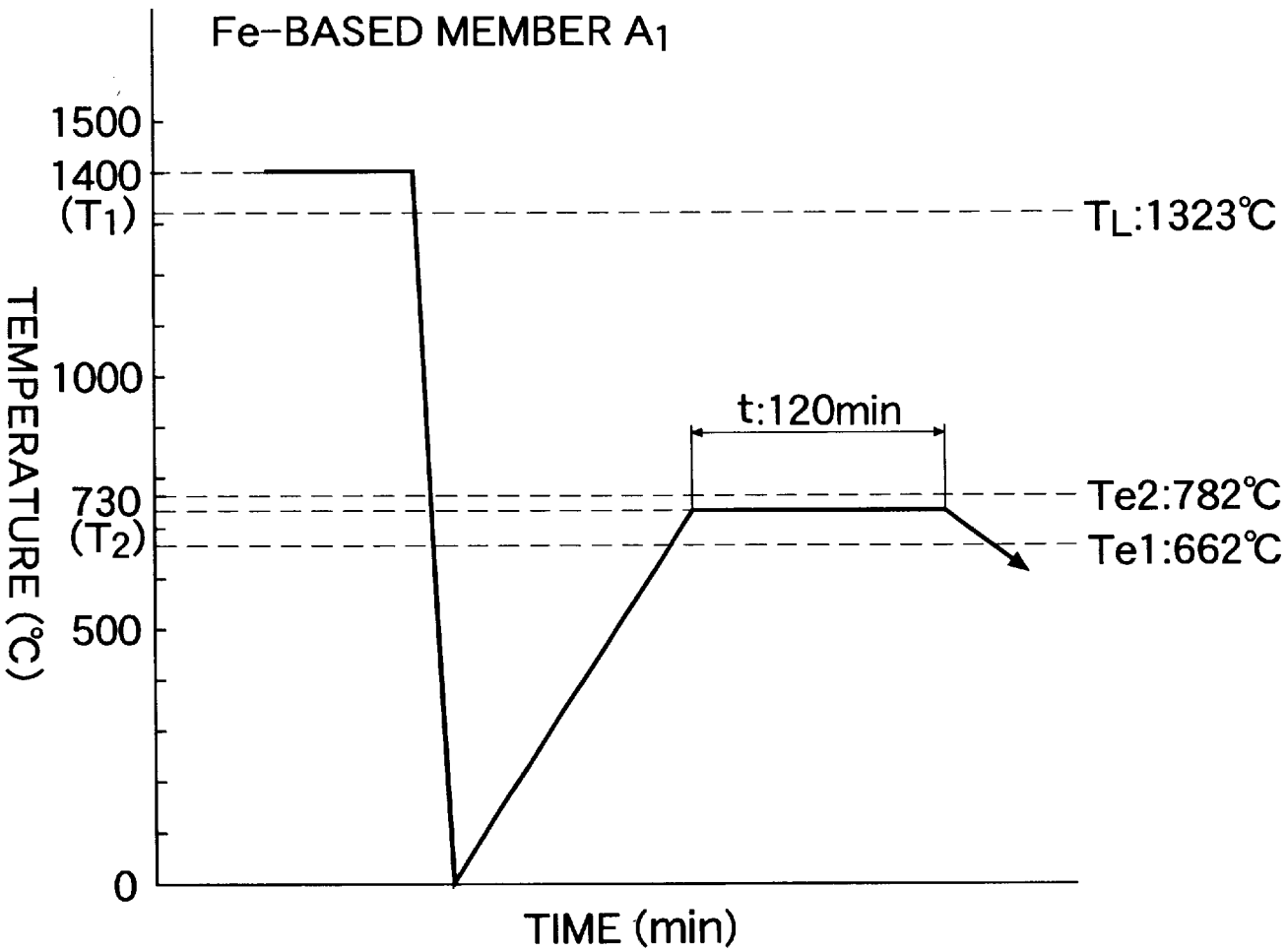
FIG. 8 shows a heat cycle for producing an Fe-based member $A_1$.

FIG. 6 is a photomicrograph showing the secondary thermally treated structure (metallographic structure) of the Fe-based member A, and FIG. 7 is a substantial tracing of FIG. 6. The secondary thermally treated structure comprises a large number of massive fine α-grain groups, a large number of fine short fiber-shaped carbide agglomerates and a large number of fine graphite grains present between the adjacent fine α-grain groups, a large number of fine carbide grains and aggregates as well as several fine graphite grains present in the grain boundary of the finer α-grain groups, and one or two or more acicular precipitated γ-phases present in the particular fine α-grain group and extending to divide the particular fine α-grain group.

In the secondary thermally treated structure, the fine carbide grains contribute to an increase in Young's modulus of the Fe-based member A. In order to increase the Young's modulus, it is desirable that the average number of fine carbide grains per 100 $\mu m^2$ is eight or more. This number of fine carbide grains was determined by a procedure which comprises carrying out an image analysis of the metallographic structure by a metal microscope or the like to determine the number of fine carbide grains per 100 $\mu m^2$ about a plurality of groups, and calculating the average value of these numbers. The fine short fiber-shaped carbide agglomerates also contribute to an increase in Young's modulus of the Fe-based member A.

The precipitated γ-phase(s) contributes to an enhancement in toughness of the Fe-based member A. For this purpose, it is desirable that the precipitated γ-phase content d is equal to or larger than 0.8 by weight ($d \geqq 0.8\%$ by weight). The precipitated γ-phase content d was determined by a procedure which comprises calculating the content of precipitated γ-phase from a phase diagram using a thermodynamic data base such as Thermo-Calc.

For each of the Fe-based members A and B, the average number of the fine carbide grains per 100 $\mu m^2$ and the precipitated γ-phase content d were determined by the above-described procedures; the tensile test was carried out to determine the tensile strength and the Young's modulus, and further, the Charpy impact test was carried out to determine a Charpy impact value, thereby providing results given in Table 3.

TABLE 3

| | Average number of fine carbide grains per 100$\mu m^2$ | Precipitated γ-phase content (% by weight) | Tensile strength (MPa) | Young's modulus (GPa) | Charpy impact value (J/cm$^2$) |
|---|---|---|---|---|---|
| Fe-based member A | 8.7 | 1.67 | 712 | 239 | 8.3 |
| Fe-based member B | 1.6 | — | 739 | 193 | 6.2 |
| Fe-based member $A_1$ | 8 | 1.67 | 710 | 235 | 8 |

As apparent from Table 3, it can be seen that for the Fe-based member A according to the example, the Young's modulus is about 1.2 times as high as and the Charpy impact value is about 1.3 times as large as those of the Fe-based member B according to the comparative example and therefore, the Fe-based member A according to the example has a higher Young's modulus and a higher toughness.

Then, an Fe-based member $A_1$ was produced using the Fe-based material a shown in Table 1 by melting the Fe-based material a at a heating temperature $T_1$ equal to 1400° C. ($T_1>T_L$ =1323° C.), then carrying out the quenching of the molten material (CR : 1300° C./min), followed by a second step similar to that described above for the Fe-based member A. It was made clear that the Fe-based member $A_1$ had a thermally treated structure similar to the secondary thermally treated structure of the Fe-based member A as a result of the microscopic observation.

For the Fe-based member $A_1$, the average number of the fine carbide grains per 100 $\mu m^2$ was determined similarly as in the above-described procedure and the results shown in Table 3 were obtained. Table 3 shows that the Fe-based member $A_1$ has substantially the same properties as those of the Fe-based member A.

The first step at which the quenching is carried out at an Fe-based material heating temperature $T_1$ set in the range of $T_S<T_1<T_L$, as described above, corresponds to a thixocasting process which involves charging a semi-molten Fe-based material having solid and liquid phases coexisting therein under a pressure into a mold having a good thermal conductivity. Therefore, the present invention also includes a producing process in which a second step similar to that described above is carried out after conduction of such a thixocasting.

In addition, the first step at which the quenching is carried out at an Fe-based material heating temperature $T_1$ set in the range of $T_1>T_L$, as described above, corresponds to a casting process which involves pouring a molten metal into a mold having a good thermal conductivity. Therefore, the present invention also includes a producing process in which a second step similar to that described above is carried out after conduction of such a casting.

According to the present invention, an Fe-based member having a high Young's modulus and a high toughness can be mass-produced by employing such a particular means as described above.

What is claimed:

1. A process for producing an Fe-based member having a high Young's modulus and a high toughness, comprising a first step of subjecting an Fe-based material which comprises 1.5% by weight≦C≦2.5% by weight 1.4% by weight≦Si≦3.5% by weight 0.9% by weight≦Mn≦1.7% by weight 0.5% by weight≦Ni≦1.5% by weight, and the balance of Fe including inevitable impurities to a thermal treatment at a heating temperature $T_1$ set in a range of $T_S<T_1<T_L$ and under a quenching condition, wherein $T_S$ represents a solidus temperature of the Fe-based material and $T_L$ represents a liquidus temperature, and a second step of subjecting the Fe-based material to a thermal treatment at a heating temperature $T_2$ set in a range of Te1<$T_2$<Te2 and for a heating time t set in a range of 90 min≦t≦180 min, wherein Te1 represents a eutectic transformation starting temperature and Te2 represents a eutectic transformation finishing temperature.

2. A process for producing an Fe-based member having a high Young modulus and a high toughness, comprising a first step of subjecting an Fe-based material which is composed of 1.5% by weight≦C≦2.5% by weight 1.4% by weight≦Si≦3.5% by weight 0.9% by weight≦Mn≦1.7% by weight 0.5% by weight≦Ni≦1.5% by weight and the balance of Fe including inevitable impurities to a thermal treatment at a heating temperature $T_1$ set in a range of $T_1>T_L$ and under a quenching condition, wherein $T_L$ represents a liquidus temperature, and a second step of subjecting the Fe-based material to a thermal treatment at a heating temperature $T_2$ set in a range of Te1<$T_2$<Te2 and for a heating time t set in a range of 90 min≦t≦180 min, wherein Te1 represents a eutectic transformation starting temperature and Te2 represents a eutectic transformation finishing temperature.

3. A process for producing an Fe-based member having a high Young's modulus and a high toughness according to claim 1, wherein a large number of fine carbides are precipitated at said second step, the average number of said fine carbides per 100 $\mu m^2$ being 8 or more.

4. A process for producing an Fe-based member having a high Young's modulus and a high toughness according to claim 2, wherein a large number of fine carbides are precipitated at said second step, the average number of said fine carbides per 100 $\mu m^2$ being 8 or more.

* * * * *